US010227886B2

(12) United States Patent
Sebrecht

(10) Patent No.: US 10,227,886 B2
(45) Date of Patent: Mar. 12, 2019

(54) MECHANISM FOR DRIVING BLADE ORIENTATION ADJUSTING MEMBERS

(71) Applicant: SAFRAN AIRCRAFT ENGINES, Paris (FR)

(72) Inventor: Pierre-Alain Francis Claude Sebrecht, Paris (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 321 days.

(21) Appl. No.: 14/971,213

(22) Filed: Dec. 16, 2015

(65) Prior Publication Data

US 2016/0177775 A1 Jun. 23, 2016

(30) Foreign Application Priority Data

Dec. 18, 2014 (FR) ..... 14 62802

(51) Int. Cl.

| | |
|---|---|
| ***F01D 7/00*** | (2006.01) |
| ***F01D 17/14*** | (2006.01) |
| ***F01D 17/16*** | (2006.01) |
| ***F04D 29/56*** | (2006.01) |
| ***F01D 9/04*** | (2006.01) |
| ***F04D 27/02*** | (2006.01) |

(52) U.S. Cl.

CPC ..... *F01D 17/14* (2013.01); *F01D 9/041* (2013.01); *F01D 17/141* (2013.01); *F01D 17/162* (2013.01); *F01D 17/165* (2013.01); *F01D 17/167* (2013.01); *F04D 27/0246* (2013.01); *F04D 29/563* (2013.01); *F05D 2220/323* (2013.01); *F05D 2240/12* (2013.01)

(58) Field of Classification Search

CPC ..... F01D 17/14

See application file for complete search history.

(56) References Cited

U.S. PATENT DOCUMENTS 2,933,235 A * 4/1960 Neumann ..... F01D 17/162 415/149.4
3,318,574 A * 5/1967 Tyler ..... F01D 17/16 415/148
3,632,224 A * 1/1972 Wright ..... F01D 17/162 415/147

(Continued)

OTHER PUBLICATIONS

French Preliminary Search Report dated Aug. 31, 2015 in French Application 14 62802 filed on Dec. 18, 2014 (with English Translation of Categories of Cited Documents).

*Primary Examiner* — Igor Kershteyn
*Assistant Examiner* — Jason Fountain
(74) *Attorney, Agent, or Firm* — Oblon, McClelland, Maier & Neustadt, L.L.P.

(57) ABSTRACT

A drive mechanism is provided for driving at least two adjusting members used to adjust the orientation of the blades of a turbomachine rectifier vane associated therewith, where the drive mechanism simultaneously drives the displacement of at least two adjusting members in the turbomachine. A single threaded rod drives several levers, each lever being associated with an adjusting member. A first part of each lever engages with the threaded rod and one end of an arm of the lever is connected to the adjusting member associated therewith so that the rotation of the threaded rod causes a simultaneous rotation of the levers associated with the adjusting members.

7 Claims, 1 Drawing Sheet

(56) References Cited

U.S. PATENT DOCUMENTS

| | | | | |
|---|---|---|---|---|
| 4,049,360 | A * | 9/1977 | Snell | F01D 17/162 415/149.4 |
| 6,382,559 | B1 * | 5/2002 | Sutterfield | B64C 15/02 244/12.4 |
| 9,322,325 | B2 * | 4/2016 | Mori | F02B 37/24 |
| 2016/0040584 | A1 * | 2/2016 | Russalian | F04D 15/0038 417/278 |
| 2017/0276148 | A1 * | 9/2017 | Suciu | F04D 29/542 |
| 2018/0202321 | A1 * | 7/2018 | Spangler | F01D 25/34 |

* cited by examiner

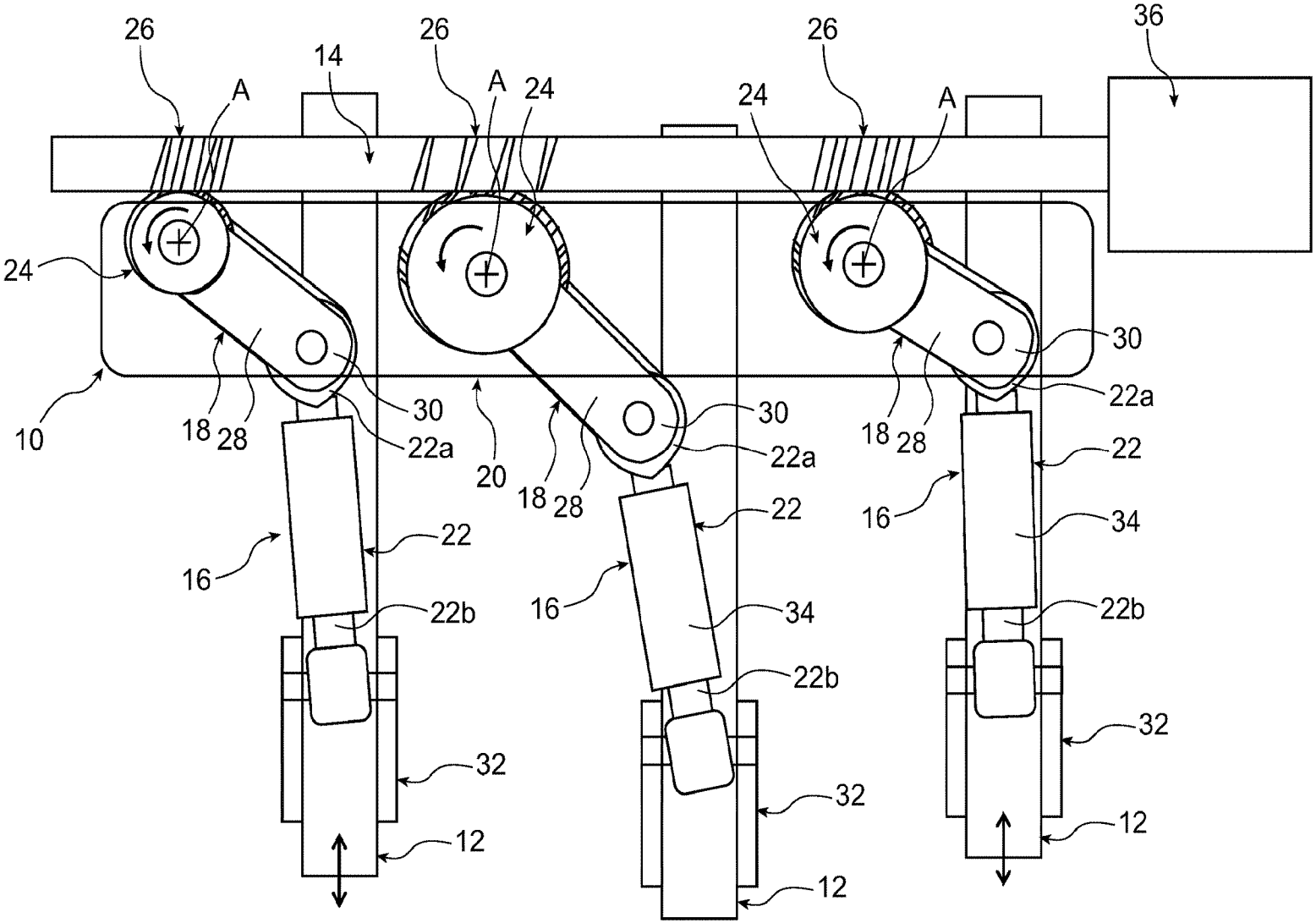
36
30
22a
22
34
22b
32
12
A
26
24
18
28
16
20
14
10

MECHANISM FOR DRIVING BLADE ORIENTATION ADJUSTING MEMBERS

TECHNICAL FIELD

The invention relates to a mechanism for driving adjusting members adjusting the orientation of the blades of several rectifier vanes of a turbomachine.

The invention more particularly relates to a drive mechanism for several adjusting members enabling the adjusting members to be driven simultaneously with displacement speeds differing from one adjusting member to another.

PRIOR ART

The compressor and/or the turbine of a turbomachine are formed from several vanes, each vane comprising a gas flow rectifier.

The orientation of the rectifier blades is known to be modified as a function of the operating conditions of the turbomachine in order to optimise the latter's yield.

According to one known embodiment, the modification of the orientation of the rectifier blades is controlled via an actuator including a drive shaft that engages with a member associated with each blade, or a blade orientation control unit.

Although the use of a single shaft for driving the blades of two rectifier vanes helps limit the number of components in the turbomachine, this system has particularly large dimensions, which means that this solution is preferred for large-scale turbomachines.

The use of a control unit can be adapted to suit all turbomachine sizes. However, this solution involves a large number of components, which reduces system accuracy due to the cumulated gaps between the many components and their respective deformations.

The purpose of the invention is to propose a mechanism for driving blade orientation adjusting members that has reduced dimensions and that comprises a reduced number of parts.

DESCRIPTION OF THE INVENTION

The invention concerns a drive mechanism for driving at least two adjusting members, each adjusting member being used to adjust the orientation of the blades of a turbomachine rectifier vane associated therewith, the drive mechanism comprising means for simultaneously driving the displacement of said at least two adjusting members in the turbomachine, characterised in that it comprises a single threaded rod and several levers, each lever being associated with an adjusting member, wherein a first part of each lever engages with the threaded rod and wherein one end of an arm of said lever is connected to the adjusting member associated therewith, so that the rotation of the threaded rod causes a simultaneous rotation of the levers associated with the adjusting members.

Preferably, the first part of each lever forms a cogwheel centred around the pivot axis A of the lever and which engages with the threaded rod.

Preferably, the threaded rod comprises a threaded portion, which is associated with each lever and with which the first part of the lever associated therewith engages.

Preferably, the pitch of the threaded portion that is associated with a lever is different from the pitch of the threaded portion that is associated with another lever.

Preferably, the pitch of a threaded portion is variable along the threaded rod.

Preferably, the dimensions of the first part and/or of the arm of a lever are different from the dimensions of the first part and/or of the arm respectively, of another lever.

Preferably, each adjusting member consists in a control ring that is mounted rotatably about the main axis of the turbomachine, and which is connected to said end of the arm of the lever associated therewith, via a control rod.

Preferably, the length of the control rod can be modified.

The invention further relates to an aircraft turbomachine comprising at least two rectifier vanes, wherein the orientation of the blades of each rectifier vane can be modified, characterised in that each rectifier vane comprises a member for adjusting the orientation of the blades of said rectifier vane, the adjusting members being capable of moving in rotation in the turbomachine around the main axis of the turbomachine and being driven in rotation by a drive mechanism according to the invention.

BRIEF DESCRIPTION OF THE FIGURES

Other characteristics and advantages of the invention shall be better understood upon reading the following detailed description given with reference to the appended FIGURE, in which the single FIGURE is a schematic representation of a drive mechanism according to the invention.

DETAILED DESCRIPTION OF THE SPECIFIC EMBODIMENTS

The single FIGURE shows a mechanism 10 for driving adjusting members 12 for adjusting the orientation of the blades (not shown) of several turbomachine rectifier vanes.

Each of the adjusting members 12 consists in a ring associated with a rectifier vane of a turbomachine, which is capable of moving in rotation in the turbomachine about the main axis of the turbomachine (not shown). In this regard, the turbomachine comprises means connecting each ring 12 to the blades of the rectifier vane associated therewith, such that the rotation of the ring 12 results in the simultaneous modification of the orientation of each of the associated blades. For the purposes of illustration and in no way limiting the invention, these connection means comprise levers connecting each blade to the ring 12.

In this example, three adjusting members/rings 12 associated with three rectifier vanes are shown. It is understood that the invention is not limited to this number of rectifier vanes and rings 12, as the drive mechanism 10 can concern only two rings 12 associated with two rectifier vanes or more.

Therefore, the rotation of a ring 12 in the turbomachine causes the simultaneous rotation of all blades of the rectifier vane associated therewith.

When changing the operating conditions of the turbomachine, the orientation of the blades of all rectifier vanes must be simultaneously modified in order to optimise the turbomachine's performance. Moreover, the blades of each rectifier vane rotate by an angle that differs in relation to the angle of rotation of the blades of the other rectifier vanes.

The drive mechanism 10 for the adjusting rings 12 is designed for simultaneously driving the movement of the two rings 12 and so that the magnitude of the displacement of the rings 12 differs from one ring to the others.

In order to simultaneously drive the adjusting rings 12, the drive mechanism comprises a single threaded rod 14 which is associated with all of the adjusting members 12 and a coupling system 16 connecting each adjusting member 12 to the threaded rod 14.

Each coupling system 16 comprises a lever 18 that is rotatably mounted in a control unit 20 common to all of the coupling systems 16 and that is coupled to the threaded rod 14, and a control rod 22 connecting the lever 18 to the adjusting ring 12 associated with the coupling system.

The lever 18 comprises a first part 24 that engages with a threaded portion 26 of the threaded rod 14 associated therewith, and which consists in this case of a cogwheel centred around the hinge axis A of the lever 18 in relation to the control unit 20. The toothing of this cogwheel 24 is complementary to the threaded portion 26 associated therewith.

The lever 18 further comprises an arm 28 that crosses the control unit 20, and wherein the end 30 of the arm 28 that exits the control unit 20 is connected to the control rod 22.

A first end 22*a* of the control rod 22 is connected to the free end 30 of the arm 28 by a standard hinge, the second end 22*b* of the control rod 22 is connected to the adjusting ring 12 via a bracket 32 supported by the associated adjusting ring 12.

Preferably, the control rod 22 consists in a stretching screw, the length of which can be adjusted by turning its central body 34 about the main axis of the control rod 22.

When the threaded rod 14 rotates about its main axis, being driven by an electric motor 36, the lever 18 rotates about its main axis A. The lever 18 thus exerts a traction or pushing force on the control rod 22, which in turn drives the associated adjusting ring 12 in rotation about the main axis of the turbomachine.

As previously stipulated, the coupling systems 16 are all connected to the threaded rod 14. Therefore, when the threaded rod 14 rotates about its main axis, the coupling systems 16 drive all the adjusting rings 12 in rotation simultaneously.

The blade orientation adjustment thus takes place at the same time, however the rotational magnitude of the blades of one rectifier vane is generally different from the rotational magnitude of the blades of another rectifier vane.

For this purpose, the dimensions of the lever 18 of a coupling system 16 are different from the dimensions of the lever 18 of another coupling system 16.

In particular, the diameter of the cogwheel 24 of one lever 18 is different from the diameter of the cogwheel of another lever 18.

Therefore, the length of the arm 28 of one lever is different from the length of the arm 28 of another lever 18.

It is understood that the differences between the diameters of the cogwheels 24 or between the lengths of the levers 28 can be applied simultaneously or separately from one lever to another, according to the difference in the rotational magnitude from one ring 12 to another.

Therefore, in order to obtain different rotational magnitudes between two rings 12, the threaded portions 26 of the threaded rod 14 can be adapted.

For this purpose, according to a first embodiment, the pitch of a threaded portion 26 is different from the pitch of another threaded portion 26. The pitch variation of the threaded portion 26 can be continuous or discontinuous, i.e. the pitch of a section of the threaded portion is continuous and the pitch of another section of the threaded portion is different from the pitch of the first section.

According to another embodiment, the pitch of a threaded portion 26 is variable along the threaded rod 14. Therefore, when the threaded rod 14 rotates about its main axis, the pitch of the threaded portion 26, with which the first part 24 of the lever 18 engages, changes.

This provides for a non-linear control, or a control that is not proportional to the movement of a ring 12. Moreover, this non-linearity between the different rings 12 is directly managed at the level of the control rod and the levers. The drive mechanism 10 therefore does not require any additional workpiece to perform this function.

The first part 24 of the lever 18 that is associated with a threaded portion 26 is formed in a complementary manner to said threaded portion, i.e. the pitch of this cogwheel is identical to the pitch of the threaded portion 26 and said pitch is, where applicable, also variable as a function of the angular position of the first part 24 of the lever 18 about its pivot axis A.

Such a drive mechanism 10 comprises a main rod for driving the adjusting members 12, which is capable of moving in rotation about its main axis. The rod therefore undergoes no additional travel, which would require providing it with additional volume in the turbomachine.

Therefore, the turbomachine comprising such a mechanism for driving adjusting members adjusting the orientation of the blades of the rectifier vanes, therefore benefits from optimised dimensions.

The invention claimed is:

1. A drive mechanism for simultaneously driving displacement of at least two adjusting members, each adjusting member being used to adjust the orientation of blades of a turbomachine rectifier vane associated therewith, the drive mechanism comprising:

a single threaded rod;

a plurality of levers;

an adjusting member associated with each of the levers of said plurality of levers, wherein a first part of each lever of said plurality of levers engages with the threaded rod and wherein one end of an arm of each lever of said plurality of levers is connected to the adjusting member associated therewith, so that the rotation of the threaded rod causes a simultaneous rotation of the levers associated with the adjusting members, wherein the first part of each lever of said plurality of levers forms a cogwheel centered around a pivot axis of the lever and which cogwheel engages with the threaded rod.

2. The drive mechanism according to claim 1, wherein the dimensions of at least one of the first part and the arm of each lever of said plurality of levers is different from the dimensions of at least one of a respective first part and arm-of another lever of said plurality of levers.

3. The drive mechanism according to claim 1, wherein each adjusting member comprises a control ring that is mounted rotatably about a main axis of a turbomachine having the turbomachine rectifier, and which control ring is connected to said end of the arm of the lever of said plurality of levers associated therewith, via a control rod.

4. The drive mechanism according to claim 3, wherein a length of the control rod is adjustable.

5. A drive mechanism for simultaneously driving displacement of at least two adjusting members, each adjusting member being used to adjust the orientation of blades of a turbomachine rectifier vane associated therewith, the drive mechanism comprising:

a single threaded rod;

a plurality of levers;

an adjusting member associated with each of the levers of said plurality of levers, wherein a first part of each lever of said plurality of levers engages with the threaded rod and wherein one end of an arm of each lever of said plurality of levers is connected to the adjusting member associated therewith, so that the rotation of the threaded rod causes a simultaneous rotation of the levers associated with the adjusting members, wherein the threaded rod comprises a threaded portion associated with each lever of said plurality of levers and with which the first part of the lever of said plurality of levers associated therewith engages, wherein a pitch of the threaded portion that is associated with each lever of said plurality of levers is different from a pitch of the threaded portion that is associated with another lever of said plurality of levers.

6. The drive mechanism according to claim 5, wherein the pitch of the threaded portion associated with each lever of said plurality of levers is variable along the threaded rod.

7. An aircraft turbomachine comprising at least two rectifier vanes, wherein the orientation of the blades of each rectifier vane can be modified, wherein each rectifier vane comprises an adjusting member for adjusting the orientation of the blades of said rectifier vane, the adjusting members being capable of moving in rotation in the turbomachine around a main axis of the turbomachine and being driven in rotation by a drive mechanism comprising:

a single threaded rod;

a plurality of levers;

an adjusting member associated with each of the levers of said plurality of levers, wherein a first part of each lever of said plurality of levers engages with the threaded rod and wherein one end of an arm of each lever of said plurality of levers is connected to the adjusting member associated therewith, so that the rotation of the threaded rod causes a simultaneous rotation of the levers associated with the adjusting members, wherein the first part of each lever of said plurality of levers forms a cogwheel centered around a pivot axis of the lever and which cogwheel engages with the threaded rod.

* * * * *